United States Patent [19]

Douglas

[11] 4,322,858

[45] Apr. 6, 1982

[54] PROTECTIVE GARMENTS FOR FOOTBALL PLAYERS

[75] Inventor: Huey Douglas, Baton Rouge, La.

[73] Assignee: Douglas Equipment Manufacturing Co., Baton Rouge, La.

[21] Appl. No.: 76,074

[22] Filed: Sep. 17, 1979

[51] Int. Cl.[3] ..... A41D 13/00

[52] U.S. Cl. ..... 2/2; 2/2.5; 2/51

[58] Field of Search ..... 2/2 R, 2.5, 51, 93, 2/94

[56] References Cited

U.S. PATENT DOCUMENTS

| | | | |
|---|---|---|---|
| 921,352 | 5/1909 | Blaker et al. | 2/2 X |
| 1,915,754 | 6/1933 | O'Shea | 2/2 |
| 3,158,871 | 12/1964 | Morgan | 2/2 |
| 3,611,438 | 10/1971 | Gregg et al. | 2/51 |
| 3,739,397 | 6/1973 | Truelove | 2/2 |

FOREIGN PATENT DOCUMENTS

| | | | |
|---|---|---|---|
| 595790 | 2/1978 | Switzerland | 2/51 |
| 136689 | 4/1961 | U.S.S.R. | 2/51 |

*Primary Examiner*—H. Hampton Hunter

*Attorney, Agent, or Firm*—Roy, Kiesel, Patterson & McKay

[57] ABSTRACT

Garments for the protection of a football player's ribs and jaws are disclosed utilizing lightweight overlapping flexible jointed flap members attached together by cloth padding to cover the player's rib cage or other parts of the body.

1 Claim, 7 Drawing Figures

PROTECTIVE GARMENTS FOR FOOTBALL PLAYERS

BACKGROUND OF THE INVENTION

1. Field of the Invention

This invention relates broadly to wearing apparel and, more particularly, to protective jackets to protect football players from injuries resulting from blows to the rib cage.

2. Prior Art

In violent contact sports, such as football, the players are constantly subjected to blows that result in broken or cracked bones. In particular, the player's rib cage and jaw area have been areas of frequent injury.

To reduce these injuries, numerous types of padding, helmets and even flack jackets have been employed. However, the need for flexible, lightweight garments that do not restrict the player's movements but which afford more reliable, better protection against broken or cracked bones, particularly to the rib cage and jaw, are still desired.

SUMMARY OF THE INVENTION

Therefore, it is an object of this invention to provide garments to be worn by football players which reduce the possibility of injury to the player's body.

Another object of this invention is to provide a protective vest to be worn by a football player that is flexible, lightweight and which helps prevent broken or cracked ribs.

Still another object of this invention is to provide a jaw protector garment designed to be worn by a football player.

Other objects and advantages of this invention will become apparent from the ensuing descriptions of the invention.

Accordingly, a protective jacket to be worn by football players is provided comprising overlapping flexible plastic flaps hingingly attached to a cloth piece wherein the flaps are arranged in four columns, each extending the length of the player's rib cage, two of the columns being fittingly connected in the front of the player by laced strings attached to the cloth and having a fifth column of overlapping flexible plastic flaps positioned over the player's spinal column, the front and back columns being fittingly connected at each of the player's sides by laced strings attached to the cloth.

PREFERRED EMBODIMENTS OF THE INVENTION

Figure 1:
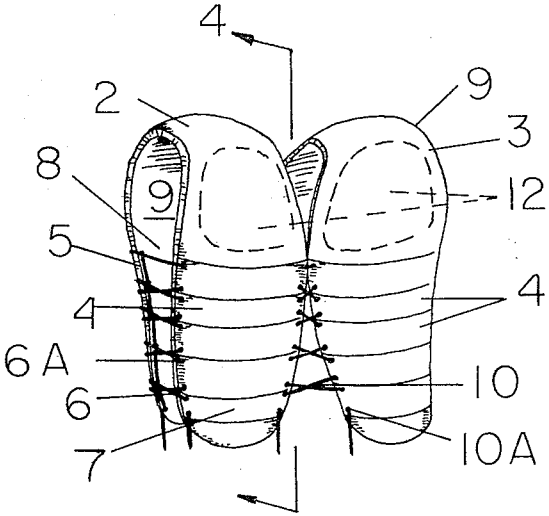
FIG. 1 is a three dimensional frontal view of one preferred embodiment of the rib cage design of this invention.

As seen in FIGS. 1–5, a protective rib cage garment, denoted generally by the numeral 1, comprises liner cloth pieces 2 and 3 that each form a front section 4 and back section 5. Each piece 2 and 3 are connected on one side by laced strings 6 passing through eyelets 6A that extend from the bottom area 7 of each section 4 and 5 upward to a point 8 that leaves a sufficient opening 9 through which an arm can extend. Pieces 2 and 3 are connected in the front by a second laced string 10 passing through eyelets 10A. In the back, pieces 2 and 3 are connected together by stitching. In this manner, a vest shaped liner is formed.

Attached to the front and back sections 4 and 5 are overlapping flexible plastic or rubber flaps 11 that extend over the wearer's rib cage. Each flap 11 preferably comprises a relatively thin, convex shaped shock absorbing member 11A to which is attached, along the top portion of member 11A, a cloth piece 11B. This cloth piece 11B preferably extends across the entire top length of member 11A and then is bent back around so that it can be sewn to liner cloth pieces 2 or 3. In this manner, flap member 11A is hingedly connected and, thus, will move somewhat when being struck. Also, since it is preferred that member 11A be constructed of material having flexibility, it too will flatten somewhat out when being struck; thus, absorbing some of the force. Since flap members 11A are overlapped, their end 11C will rest on surface 11D of the adjacent lower flap member, which results in an even more resilient structure design, particularly when surface 11D is smooth.

In another preferred embodiment, rubber or cloth padding 12 is attached in conventional manner above flaps 11 to protect the chest and upper back and shoulder blade areas of the body. It is also noted that flaps 11 could also be secured to front and back sections by placing them in cloth pockets attached to the sections in a manner similar to that used for padding.

Figure 2:
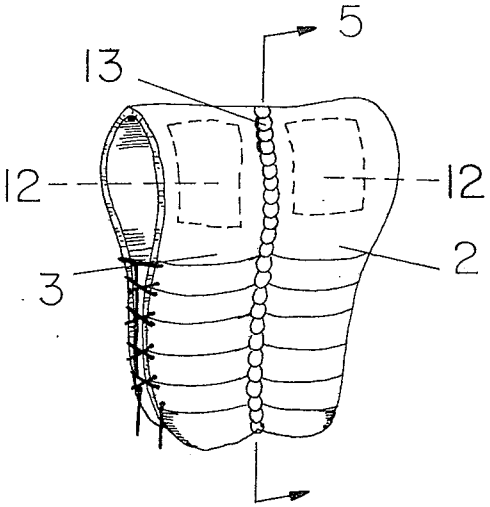
FIG. 2 is a three dimensional rear view of one preferred embodiment of the rib cage design of this invention.
Figure 3:
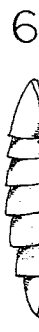
FIG. 3 is a three dimensional side view of one preferred embodiment of the rib cage design of this invention.
Figure 4:
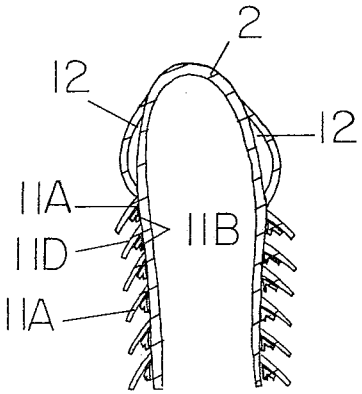
FIG. 4 is a cross-sectional view taken along lines 4—4 of FIG. 1.
Figure 5:
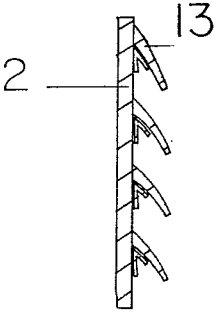
FIG. 5 is a cross-sectional view taken along lines 5—5 of FIG. 2.

In still another preferred embodiment, spinal column flaps 13 are provided to prevent damage to the spinal column when the player is struck from the rear. These flaps are similar in construction to flaps 11, but are shaped to fit only over the spinal cord area as seen in FIG. 2. They are attached by sewing to liner cloth pieces 2 and 3.

Figure 7:
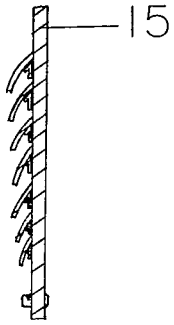
FIG. 7 is a cross-sectional view taken along lines 7—7 of FIG. 6.
Figure 6:
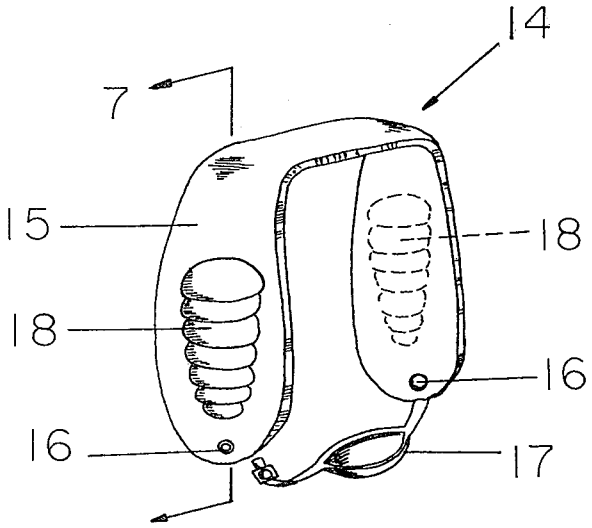
FIG. 6 is a three dimensional view of a preferred embodiment of the jaw protector of this invention.

As seen in FIGS. 6 and 7, a jaw protective garment, denoted generally by the numeral 14, is provided comprising a cloth strap piece 15 that fits over the top of a player's head and extends down each side of his face covering the back part of the player's jaw. At the bottom of each end of strap piece 15 are conventional snap connections 16 to which a chin strap 17 can attach to hold jaw protective garment 14 in place.

Attached to head piece 15 are flaps 18 similar in design to flaps 11, but shaped and positioned to cover the player's back jaw area.

There are, of course, many obvious modifications and other embodiments not specifically disclosed, but which are intended to be included within the scope of this invention as defined by the following claims.

What I claim is:

1. A protective jacket to be worn by a person to protect the rib cage of said person, comprising:

(a) liner cloth pieces adjustably attached to one another and provided with arm openings through which the arms of said person can pass, said cloth pieces fitting over the shoulders of said person and extending below the rib cage of said person; and (b) flap assemblies having over-lapping, flexible convex shaped flaps hingedly attached to said liner cloth pieces, said flaps being arranged in five columns, two of said columns being positioned over that portion of said rib cage in front of said person, two other of said columns being positioned over that portion of said rib cage in back of said person and a fifth column being positioned to fit over the spinal column of said person.

* * * * *